US008499533B2

(12) United States Patent
Emond et al.

(10) Patent No.: US 8,499,533 B2
(45) Date of Patent: Aug. 6, 2013

(54) METHOD AND APPARATUS FOR WRAPPING A SHIPMENT

(75) Inventors: Jean-Pierre Emond, Tampa, FL (US); William Pelletier, Gainesville, FL (US)

(73) Assignee: Blueye, LLC, Mango, FL (US)

( * ) Notice: Subject to any disclaimer, the term of this patent is extended or adjusted under 35 U.S.C. 154(b) by 0 days.

(21) Appl. No.: 13/174,143

(22) Filed: Jun. 30, 2011

(65) Prior Publication Data

US 2011/0252749 A1 Oct. 20, 2011

Related U.S. Application Data

(62) Division of application No. 12/177,030, filed on Jul. 21, 2008.

(60) Provisional application No. 60/950,970, filed on Jul. 20, 2007.

(51) Int. Cl.
*B65B 11/00* (2006.01)

(52) U.S. Cl.
USPC ..... 53/434; 53/443

(58) Field of Classification Search
USPC ..... 53/400, 434, 443; 206/213.1, 423, 206/459.1, 459.5, 524.1, 524.2, 524.3, 524.6
See application file for complete search history.

(56) References Cited

U.S. PATENT DOCUMENTS

| | | | | |
|---|---|---|---|---|
| 4,842,875 | A | 6/1989 | Anderson | |
| 4,886,372 | A * | 12/1989 | Greengrass et al. | 383/100 |
| 4,923,650 | A * | 5/1990 | Antoon et al. | 264/41 |

(Continued)

FOREIGN PATENT DOCUMENTS

| | | |
|---|---|---|
| EP | 0086057 | 8/1983 |
| WO | WO-98/23503 A1 | 6/1998 |
| WO | WO-03/006341 A1 | 1/2003 |

OTHER PUBLICATIONS

Office Action dated Aug. 4, 2011 in U.S. Appl. No. 12/177,030.

(Continued)

*Primary Examiner* — Hemant M Desai
(74) *Attorney, Agent, or Firm* — Saliwanchik, Lloyd & Eisenschenk

(57) ABSTRACT

Embodiments of the invention relate to a cover, a method of covering, and a cover system to be used with shipments of products transported by air with ULDs. The dimensions of the cover system can vary depending on the ULD they are designed to be used with. The cover system can also be adapted to any individual skid such as wooden or plastic pallets used for smaller loads used in air transport or any other mode of transportation. The cover system can include one or multiple parts that wrap the shipment. Each part of the cover system can be made of one or more layers. Each layer can be made of a single material or a combination of different materials, and different layers can incorporate different materials. The different parts of the cover can be made of different materials or different combination of materials. In specific embodiments, materials used for the cover system are Radio Frequency Identification (RFID) friendly. The cover system provides thermal protection to temperature-sensitive products in or on the ULD. The cover system maintains the proper relative humidity level and gas concentrations (oxygen, carbon dioxide and ethylene) for horticultural product loads. The cover system can also have antimicrobial properties. In addition, the cover system decreases the amount of water vapor released in the cargo holds which is known to affect the reliability of the aircraft smoke detection system and to cause false fire alarms.

26 Claims, 10 Drawing Sheets

U.S. PATENT DOCUMENTS

| | | | | |
|---|---|---|---|---|
| 5,105,970 | A | 4/1992 | Malone et al. | |
| 5,183,176 | A | 2/1993 | Meier et al. | |
| 5,328,743 | A | 7/1994 | Wynne et al. | |
| 5,505,950 | A * | 4/1996 | Floyd et al. | 426/404 |
| 5,727,711 | A | 3/1998 | Emond et al. | |
| 5,888,597 | A | 3/1999 | Frey et al. | |
| 5,908,649 | A * | 6/1999 | Floyd et al. | 426/109 |
| 6,357,207 | B1 | 3/2002 | Weder | |
| 6,461,702 | B2 * | 10/2002 | Gong | 428/36.6 |
| 6,730,874 | B2 * | 5/2004 | Varriano-Marston | 219/121.71 |
| 6,941,727 | B2 * | 9/2005 | Villers et al. | 53/434 |
| 6,982,643 | B2 * | 1/2006 | Garfinkle | 340/568.1 |
| 7,083,837 | B1 * | 8/2006 | Varriano-Marston | 428/34.1 |
| 7,169,451 | B2 * | 1/2007 | Clarke et al. | 428/35.2 |
| 7,279,061 | B2 * | 10/2007 | Francois | 156/237 |
| 7,601,374 | B2 * | 10/2009 | Clarke | 426/124 |
| 8,024,912 | B2 * | 9/2011 | Macleod et al. | 53/433 |
| 2003/0074334 | A1 * | 4/2003 | Garfinkle et al. | 705/500 |
| 2003/0168449 | A1 * | 9/2003 | Garfinkle et al. | 220/1.5 |
| 2004/0035872 | A1 * | 2/2004 | Garfinkle | 220/630 |
| 2004/0066887 | A1 * | 4/2004 | Garfinkle | 378/57 |
| 2005/0034420 | A1 * | 2/2005 | Radlinger et al. | 53/52 |
| 2005/0166451 | A1 * | 8/2005 | Stachnik | 47/65.7 |
| 2006/0038077 | A1 * | 2/2006 | Olin et al. | 244/137.1 |
| 2006/0073244 | A1 * | 4/2006 | Brackenridge et al. | 426/129 |
| 2006/0185993 | A1 * | 8/2006 | Wilskey et al. | 206/278 |
| 2006/0220857 | A1 * | 10/2006 | August et al. | 340/572.1 |
| 2007/0065546 | A1 * | 3/2007 | Jorgensen et al. | 426/316 |
| 2008/0034964 | A1 * | 2/2008 | Schmidt et al. | 95/12 |

OTHER PUBLICATIONS

Office Action dated Jun. 7, 2012 in U.S. Appl. No. 12/177,030.
Office Action dated Oct. 10, 2012 in U.S. Appl. No. 12/177,030.

* cited by examiner

METHOD AND APPARATUS FOR WRAPPING A SHIPMENT

CROSS-REFERENCE TO RELATED APPLICATION

The present application is a divisional of U.S. application Ser. No. 12/177,030, filed Jul. 21, 2008, which claims priority of U.S. provisional application Ser. No. 60/950,970, filed on Jul. 20, 2007, both of which are hereby incorporated by reference herein in its entirety, including any figures, tables, or drawings.

BACKGROUND OF INVENTION

Generally, a unit load device (ULD) is used to carry products by air. ULDs include both aircraft pallets and aircraft containers. During ramp transfers, before or after a flight, products transported in and/or on these ULDs can be exposed for several hours to the outside environment without any added protection. In the case of temperature-sensitive cargo, such as horticultural products, pharmaceutical products, fresh meat and fish, frozen goods and electronics, this period can be detrimental.

Plastic films sometimes used with aircraft pallets do not allow sufficient gas exchange between the load and the outside environment. The horticultural products protected by these plastic films may undergo anaerobic respiration because of the lack of oxygen. Anaerobic respiration results in the development of off-flavors and off-odors (fermentation) and often has non-reversible consequences on the quality attributes of the products.

In addition, to oxygen and carbon dioxide, ethylene is another gas that can have significant effects on the quality of horticultural products. Ethylene is a product of all organic combustion (including engines emissions) but is also a natural hormone endogenously produced by several horticultural products. Ethylene has different effects on horticultural products; some are beneficial and other detrimental (particularly for flowers). For example, ethylene will accelerate and uniformize the ripening process and contribute to the development of aromatic components. However, ethylene also causes the yellowing of green tissues, shortens the shelf life and induces bitter taste. In the case of flowers, ethylene causes leaf fading, wilting and abscission, enrolling of the petals and also failure or earlier closing of the flower buds.

A proper level of relative humidity is often important in order to avoid condensation on the packaging system of the products and/or the products themselves. Condensation often needs to be avoided for several reasons. For packaging systems made of cardboard or other paper based materials (non-waxed) or any hydrophilic materials, condensation may results in an important decrease of their nominal strength and can therefore cause the collapse of the packaging system and mechanical damage to the products. Condensation (or any free water) is also favorable to the growth of decay organisms on horticultural products. In favorable conditions, only a few hours are necessary for mold to develop. Mechanical damage to horticultural products and the presence of free water have a synergic effect on the growth of decay organisms.

Also, high relative humidity levels in the cargo hold of an aircraft are known to affect the reliability of the aircraft smoke detection system and to cause false fire alarms. Consequences of a spurious alarm can be very serious and place passengers and crew members in hazardous situations. False fire alarms result in delays, emergency landings and evacuations causing injuries to number of passengers. In some situations, the pilot may also have to choose between going on with fire alarm on or trying a sea landing. With time, a high number of false fire alarms may result in a lost of confidence of the pilots in the fire detection system and then lead to a real fire warning being ignored. Furthermore, the costs associated with aircraft evacuation emergency procedures, such as triggering of emergency doors and chutes, injuries to passengers, emergency landing fees, and delays are extremely high.

BRIEF SUMMARY

Embodiments of the invention relate to a cover, a method of covering, and a cover system to be used with shipments of products transported by air with unit load devices (ULDs). The dimensions of the cover system can vary depending on the ULD they are designed to be used with. Size variations of the cover system can also be adapted to any individual skid, such as wooden or plastic pallets used for smaller loads, transported by air or any other mode of transportation. The cover system can include one or multiple parts that wrap the shipment. Each part of the cover system can be made of one or more layers. Each layer can be made of a single material or a combination of different materials, and different layers can incorporate different materials. The different parts of the cover can be made of different materials or different combination of materials. In specific embodiments, materials used for the cover system are Radio Frequency Identification (RFID) friendly. Embodiments of the cover system can provide thermal protection to temperature-sensitive products in or on the ULD.

Embodiments of the cover system can allow the respiration of horticultural products by providing adequate gas exchange rates between the inside and the outside environments. The gas exchange can be accomplished with different techniques. The technique and the characteristics of the technique used to accomplish the gas exchange can vary depending on the size of the ULD or load, the type of products, and the packaging system of the products itself. In specific embodiments, the gas exchange technique used for the cover system can also allow the transport of water vapor in order to keep a proper relative humidity level around the products. Even though the cover system allows the transport of water vapor while maintaining a proper level of relative humidity around the products, embodiments can still present a resistance to the transport of water vapor. This characteristic of the cover system is particularly important once the ULDs are loaded in the aircraft since it restricts the amount of water vapor released in the cargo hold. High relative humidity levels in the cargo hold of an aircraft are known to affect the reliability of the aircraft smoke detection system and to cause false fire alarms.

Embodiments of the cover system can include one or more parts that incorporate a material having the capacity to absorb or eliminate certain gases, such as ethylene. In addition, antimicrobial agents imbedded in the material or added as a coating on parts or the entirety of the cover system can be used to decrease or stop the growth of microorganisms or to kill microorganisms such as bacteria or mold. These microorganisms include those susceptible to negatively affect the quality of horticultural products as well as those susceptible to cause a threat to human consumption.

DETAILED DISCLOSURE

Embodiments of the invention relate to a cover, a method of covering, and a cover system to be used with shipments of products transported by air with unit load devices (ULDs). The dimensions of the cover system can vary depending on the ULD they are designed to be used with. Size variations of the cover system can also be adapted to any individual skid, such as wooden or plastic pallets used for smaller loads, transported by air or any other mode of transportation. The cover system can include one or multiple parts that wrap the shipment.

Figure 1:
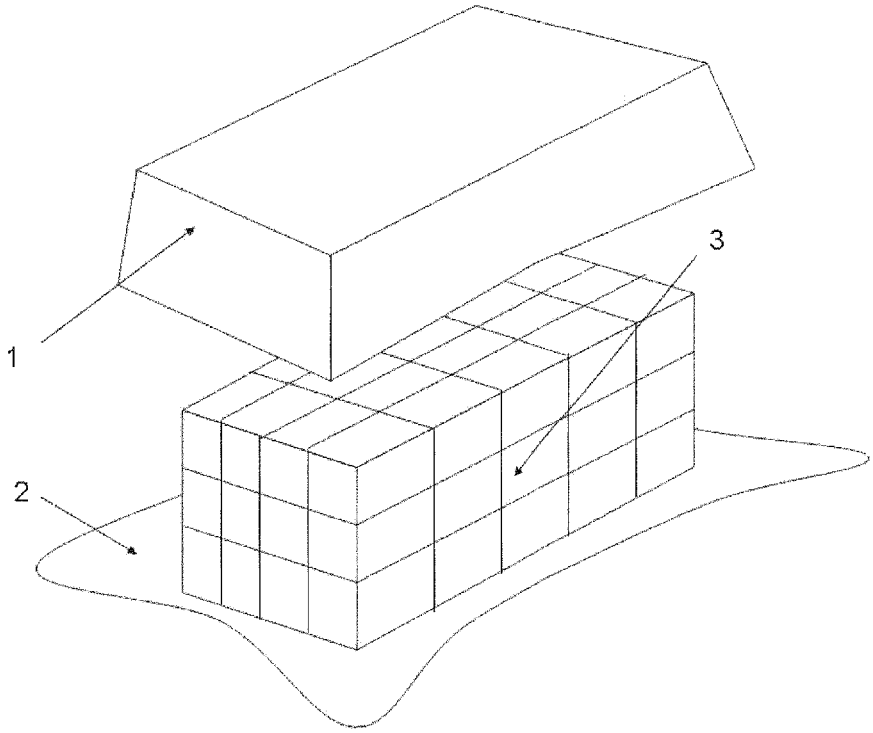
FIG. 1 shows an embodiment of a two-part cover system used for an aircraft pallet where the bottom part 2 has been installed under the products 3 and the top part 1, which allows gas and water vapor exchange with the surroundings, is being installed over the products 3.
Figure 5:
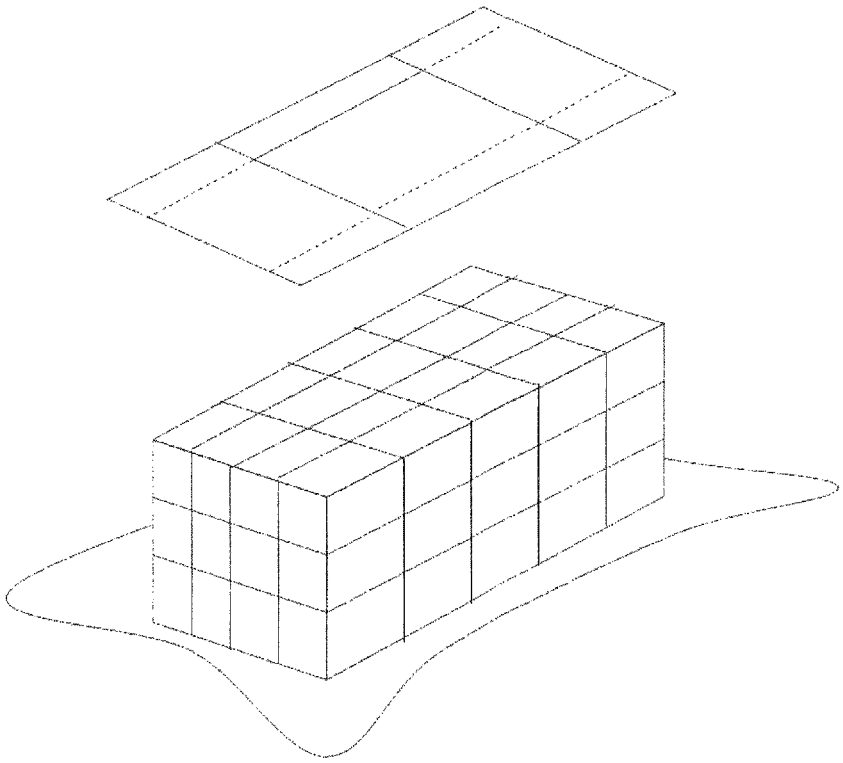
FIG. 5 shows a variation of the two-part cover system of FIG. 1.
Figure 6:
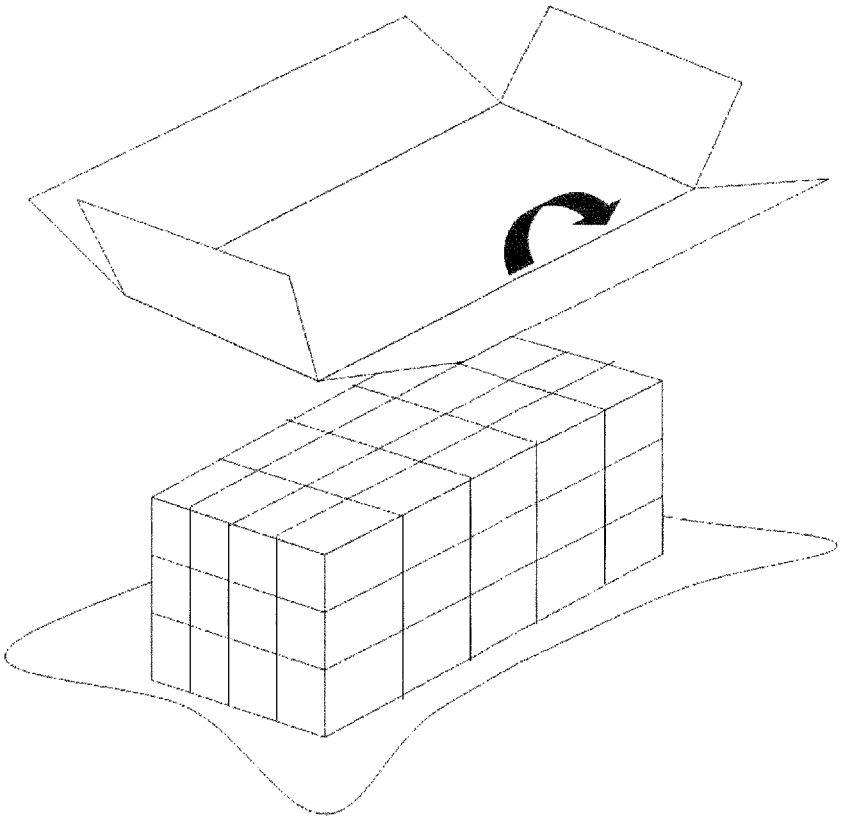
FIG. 6 shows how the top part of the two-part cover system of FIG. 5 unfolds.
Figure 7:
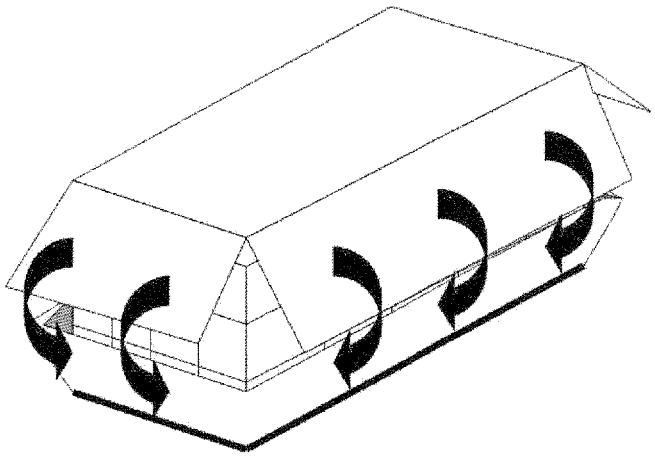
FIG. 7 shows how the top part of the cover system of FIG. 5 overlaps the bottom part to avoid the infiltration of any types of precipitation.
Figure 8:
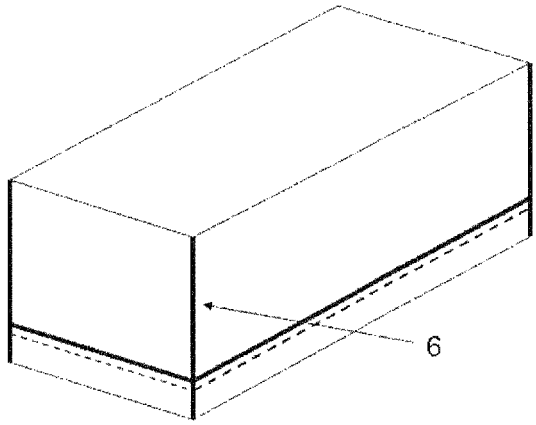
FIG. 8 shows the final installation of the cover system of FIG. 5 with the top portion overlapping the bottom portion of the cover system and tape 6 covering the junctions of the top portion of the cover system and the junction of the top and bottom portions.
Figure 9:
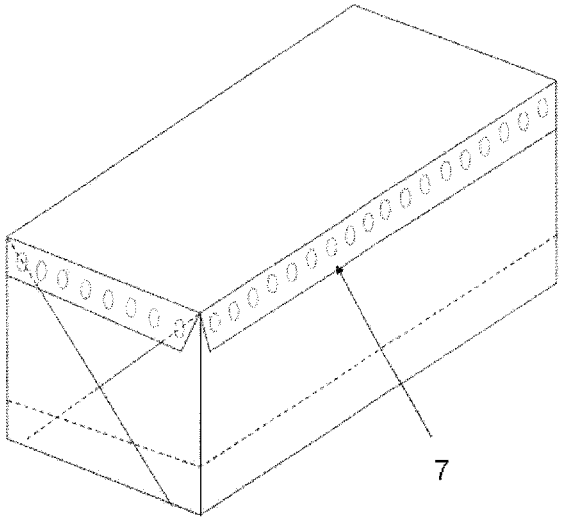
FIG. 9 shows the final installation of an embodiment of a cover system with flaps and openings 7 to allow gas and water vapor exchange with the surroundings.
Figure 10:
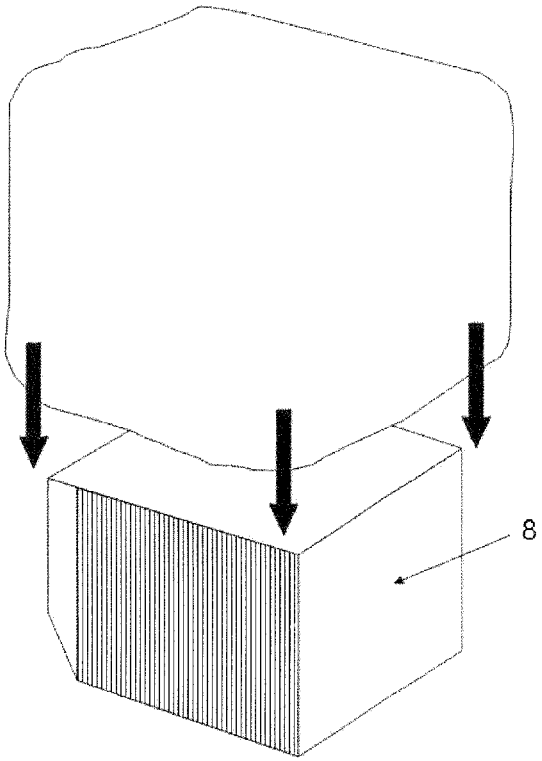
FIG. 10 shows the installation of an embodiment of a one-part cover system over a lower deck aircraft container 8.

FIGS. 1 and 5 show embodiments having multiple parts. Each part of the cover system can be made of one or more layers. Each layer can be made of a single material or a combination of different materials, and different layers can incorporate different materials. The different parts of the cover can be made of different materials or different combination of materials. Material such as TYVEK® (trademarked, DUPONT) brand flash spun polyolefin and perforated and/or non-perforated polyethylene film can be used. One or more of the junctions of the cover system can be linked together using, for example, an adhesive material or a fastening system. In an embodiment, all junctions are linked together.

Figure 2:
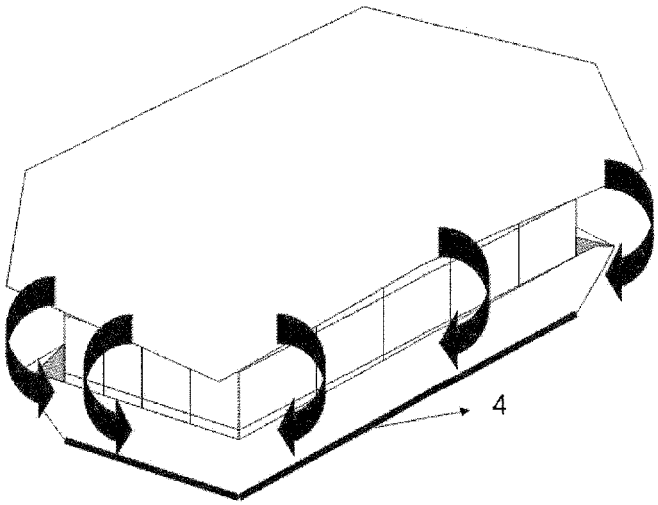
FIG. 2 shows how the top part of the cover system of FIG. 1 used with an aircraft pallet 4 overlaps the bottom part to avoid the infiltration of any types of precipitation.
Figure 3:
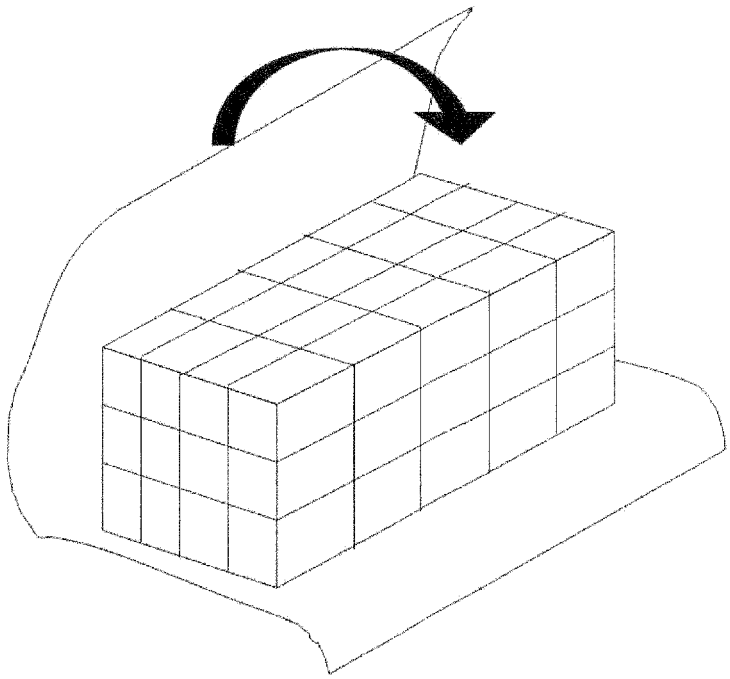
FIG. 3 shows the installation of an embodiment of a one-part cover system.
Figure 4:
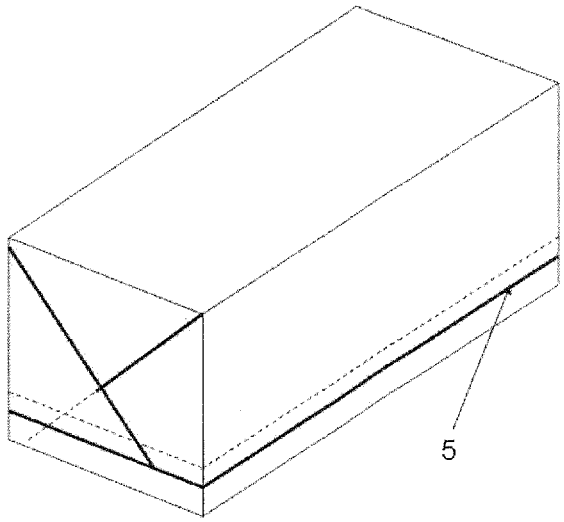
FIG. 4 shows the final installation of the cover system of FIG. 3 with the top portion overlapping the bottom portion of the cover system and tape 5 (wider lines) covering different junctions.

With respect to specific embodiments, the top part of the cover system overlaps the bottom part of the cover system at horizontal junctions, to avoid any potential water infiltration due to, for example, any type of precipitation. FIGS. 2 and 4 show examples of embodiments where the top part overlaps the bottom part and/or the top portion of a part overlaps the bottom portion of the part when installed. In specific embodiments, materials used for the cover system are RFID friendly. Embodiments can utilize materials that allow the use within, and/or under the cover system of RFID technologies such as but not limited to passive, semi-passive, active and semi-active tags. These tags can be used to store information, such as electronic airway bill, to track products, as well as to monitor different parameters, such as temperature, relative humidity, and pressure. RFID tags may also be directly imbedded in the cover.

Embodiments of the cover system provide thermal protection to temperature-sensitive products, such as horticultural products, pharmaceutical products, fresh meat and fish, frozen goods, and electronics. The thermal protection arises from the cover's effect on conductive, convective, and radiative heat transfer.

Specific embodiments of the cover system can allow the respiration of horticultural products by providing adequate gas exchange rates for gases such as oxygen and carbon dioxide between the inside (under the cover) and the outside environments. In a specific embodiment, the volumetric concentration of oxygen underneath the cover system needs to be greater than or equal to 1%, and the volumetric concentration of carbon dioxide needs to be less than or equal to 15%. The gas exchange rate for oxygen and carbon dioxide, as well as for other gases, can be accomplished with different techniques. A gas permeable material or specially perforated material can be used for the cover or for specific sections of the cover. Openings in the cover material having various shapes, sizes, number, and distribution can also be used to achieve the proper gas exchange. In a specific embodiment, the distribution of openings and the characteristics of the openings are selected to allow the intake of oxygen for the whole load while not compromising the thermal protection. The technique and the characteristics of the technique, for example, the exchange area, distribution over the cover, and other factors used to accomplished the gas exchange, depend on the size of the ULD, the type of products, its temperature, and the packaging system of the products itself. In specific embodiments, the cover systems shown in FIGS. 1, 3, 5, 9 and 10 can incorporate openings in at least a portion of the cover to enhance gas exchange.

In a specific embodiment, to allow sufficient gas exchange and avoid anaerobic respiration of certain products, the cover system having homogeneous properties is designed to have permeances for oxygen and carbon dioxide of at least $15.6\times10^3$ $L_{O2}/(m^2$ atm d) and $23.4\times10^3$ $L_{CO2}/(m^2$ atm d) respectively. These permeances were calculated to provide a modified atmosphere to horticultural products that prevents anaerobic respiration while contributing to maintaining their quality and extend their shelf life. These permeances were calculated for a cover system with homogeneous properties. Additional embodiments of the subject cover system may include different parts that may be made of different materials, the cover system's permeance to different gases is likely not to be uniform. In a specific embodiment, the total permeance of the cover system in L/(atm d), which is obtained by summing the products of the permeance of each part of the cover system and its corresponding surface area, is at least $15.6\times10^3$ $L_{O2}/(m^2$ atm d) for oxygen and $23.4\times10^3$ $L_{CO2}/(m^2$ atm d) for carbon dioxide, taking into account the entire exposed surface area of the cover system. The following describes an example for oxygen exchange:

Cover system for a lower deck PMC aircraft pallet: Width: 2.44 m, Length: 3.18 m and Height 1.57 m.

The total exposed surface area of the load is the entire surface area of the load exposed to the environment and therefore does not include the bottom which is in direct contact with the aircraft pallet. The total exposed surface area of the load can be calculated as:

$$A_{LOAD}=2\cdot(2.44\times1.57)+2\cdot(1.57\times3.18)+(2.44\times3.18)=25.4\ m^2$$

In order to fit the load, the total surface area of the cover system slightly exceeds the total exposed surface area of the load. In this case the total exposed surface area of the cover system is taken as 26.5 $m^2$.

The permeance of the cover system is $9.2\times10^3$ $L_{O2}/(m^2$ atm d) except for the two 1 $m^2$ diffusion windows having a permeance to oxygen of $97.5\times10^3$ $L_{O2}/(m^2$ atm d). To verify whether the permeance to oxygen of this cover system respects the criterion of a minimum of $15.6\times10^3$ $L_{O2}/(m^2$ atm d), the concept of total permeance can be used since the properties of the cover are not homogeneous. Therefore, in order for the cover system to have a total permeance to oxygen equal or exceeding the total permeance of a cover system having the same exposed surface area with homogeneous minimum permeance of $15.6\times10^3$ $L_{O2}/(m^2$ atm d), which can be calculated as:

$$p_{T\,MIN} = p_{MIN} \times A_{COVER}$$
$$= 15.6\times10^3 \frac{L_{O2}}{m^2\cdot atm\cdot d} \times 26.5\ m^2$$
$$= 413.4\times10^3 \frac{L_{O2}}{atm\cdot d}$$

Taking into account the diffusion windows, the total permeance of the actual cover system can be calculated by summing the products of the permeance of each part of the cover system and its corresponding surface area:

$$p_T = p_{COVER} \times (A_{COVER} - 2\cdot A_{WINDOW}) + 2\cdot(p_{WINDOW} \times A_{WINDOW})$$
$$p_T = 9.2\times10^3 \frac{L_{O2}}{m^2\cdot atm\cdot d} \times (26.5\ m^2 - 2\times1\ m^2) + 2\cdot\left(97.5\times10^3 \frac{L_{O2}}{m^2\cdot atm\cdot d} \times 1\ m^2\right)$$
$$p_T = 420.4\times10^3 \frac{L_{O2}}{atm\cdot d}$$

Since $p_T$ exceeds $p_{T\,MIN}$ the cover satisfies the criterion of the minimal permeance to oxygen. Similar calculations can be repeated in the case of the carbon dioxide. For certain commodities, oxygen and carbon dioxide permeances smaller than the minimum permeances recommended earlier ($15.6\times10^3$ $L_{O2}/(m^2$ atm d) and $23.4\times10^3$ $L_{CO2}/(m^2$ atm d) respectively) may be preferred.

In specific embodiments, the gas exchange technique used for the cover system can also allow the transport of water vapor, in order to keep a proper relative humidity level around the products (under the cover system). Incorporation of openings in the at least a portion of the covers for cover systems shown in FIGS. 1, 3, 5, 9 and 10 can allow for the transport of water vapor in accordance with specific embodiments of the invention.

Embodiments of the cover system can allow the transport of water vapor, while maintaining a proper level of relative humidity around the products, and still can provide a resistance to the transport of water vapor. Embodiments of the cover system can reduce the amount of water that may be released in the surroundings when compared with an uncovered load of horticultural products or other moisture releasing loads. Once the ULDs are loaded in the aircraft, the resistance to the transport of water vapor can restrict the amount of water vapor released in the cargo hold.

Embodiments of the cover system with homogeneous properties can allow a proper humidity level underneath the cover while limiting the amount of water vapor released in the cargo compartment by having a permeance of the cover system to water vapor between $1\times10^3$ $g_{water}/(m^2$ atm d) and $50\times10^3$ $g_{water}/(m^2$ atm d). As with oxygen and carbon dioxide permeances discussed above, comparison using the total permeance, in this case in $g_{water}$/(atm d), can be made for cover systems made of parts have different water vapor permeances. The range of water vapor permeances can calculated to take into account the different characteristics of the cargo compartments including their size, ventilation/temperature control systems (including non-ventilated cargo compartments), and the types of smoke detection systems.

Embodiments of the cover system can include one or more parts that incorporate a material having the capacity to absorb or eliminate certain gases, such as ethylene, from the surrounding environment (aircraft, ramp vehicles, etc.) as well as from the horticultural products themselves. Embodiments of the cover system can be designed to absorb or eliminate ethylene coming from both exogenous and endogenous sources and can have the capability to reduce the ethylene concentration to harmless levels (<0.01 ppm) around and within loads of horticultural products.

Antimicrobial agents can also be imbedded in the cover material or added as a coating on parts or the entirety of the cover system. These antimicrobial agents decrease or stop the growth of microorganisms or kill microorganisms such as bacteria or mold. These microorganisms include those susceptible to negatively affect the quality of horticultural products as well as those susceptible to cause a threat to human consumption.

The cover in accordance with various embodiments of the invention can protect the load from one or more of the following: precipitation, condensation, dust, wind, insects, and small animals.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A method for covering a load on a unit load device or on a skid, comprising:

covering a load on a unit load device or on a skid transported by air, securing the cover in a covered position around the load on or in the unit load device or on the skid, wherein the cover provides thermal protection to the load on or in the unit load device or on the skid from conductive and convective heat transfer, wherein the cover has a permeance for oxygen of at least $15.6\times10^3$ $Lo_2/(m^2$ atm d), wherein the cover has a permeance for carbon dioxide of at least $23.4\times10^3$ $Lco_2/(m^2$ atm d), and wherein the cover has a permeance for water vapor between $1\times10^3$ $g_{water}$(m2 atm d) and $50\times10^3$ $g_{water}/(m^2$ atm d).

2. The method according to claim 1, wherein the cover is adapted for covering various size loads on the unit load device or on the skid.

3. The method according to claim 1, wherein the cover comprises an outside surface with physical properties affecting radiative heat transfer with the surrounding environment in such a way that the cover helps to maintain the temperature of the load.

4. The method according to claim 1, wherein the cover comprises a single layer.

5. The method according to claim 1, wherein the cover comprises multiple layers.

6. The method according to claim 1, wherein the cover comprises multiple parts.

7. The method according to claim 6, wherein a first of the multiple parts has a first permeance for oxygen and a first permeance for carbon dioxide, wherein a second of the multiple parts has a second permeance for oxygen and a second permeance for carbon dioxide, wherein the first permeance for oxygen is different than the second permeance for oxygen and the first permeance for carbon dioxide is different than the second permeance for carbon dioxide, wherein the permeance for oxygen is determined by the first permeance for oxygen, the second permeance for oxygen, and permeances for oxygen of any other of the multiple parts, wherein the permeance for carbon dioxide is determined by the first permeance for carbon dioxide, the second permeance for carbon dioxide, and permeances for carbon dioxide of any other of the multiple parts.

8. The method according to claim 1, wherein the cover allows the respiration of horticultural products by providing adequate gas exchange rates of oxygen and carbon dioxide between the load and the surrounding environment.

9. The method according to claim 1, wherein the cover allows water vapor exchange between the load and the surrounding environment.

10. The method according to claim 9, wherein the water vapor exchange between the load and the surrounding environment acts to maintain a level of relative humidity to avoid condensation on the load.

11. The method according to claim 1, wherein the cover allows the exchange of gases between the load and the surrounding environment.

12. The method according to claim 11, wherein when the load is horticultural products the exchange of gases between the load and the surrounding environment acts to allow the respiration of the horticultural products by providing adequate gas exchange rates of oxygen and carbon dioxide between the horticultural products and the surrounding environment.

13. The method according to claim 1, wherein for a covered load loaded in an aircraft cargo hold, the cover allows the exchange of water vapor between the load and the aircraft cargo hold environment so as to avoid a release of water vapor in the aircraft cargo hold sufficient to trigger an aircraft cargo hold compartment smoke detection system.

14. The method according to claim 1, wherein the cover comprises a material that absorbs or eliminates ethylene.

15. The method according to claim 14, wherein a concentration of ethylene around the load is <0.01 ppm.

16. The method according to claim 1, wherein the cover comprises a material imbedded or coated with antimicrobial agents that will decrease and/or stop the growth of microorganisms and/or kill microorganisms.

17. The method according to claim 1, wherein the cover protects the covered shipment from one or more of the following: precipitation, condensation, dust, wind, insects, and small animals.

18. The method according to claim 1, wherein the cover is made entirely or partially from a material or a combination of materials that is RFID friendly.

19. The method according to claim 1, wherein the cover allows the use on and/or under the cover system of RFID tags such as but not limited to passive, semi-passive, active, semi-active.

20. The method according to claim 1, wherein the cover is perforated.

21. The method according to claim 1, wherein the cover comprises flash spun polyolefin.

22. The method according to claim 1, wherein the cover has a homogeneous permeance for oxygen of at least $15.6\times10^3$ $L_{O2}/(m^2$ atm d) and a homogeneous permeance for carbon dioxide of at least $23.4\times10^3$ $L_{CO2}/(m^2$ atm d).

23. The method according to claim 1, wherein an oxygen concentration inside the cover is substantially the same as an oxygen concentration outside of the cover.

24. The method according to claim 23, wherein a carbon dioxide concentration inside the cover is substantially the same as a carbon dioxide concentration outside of the cover.

25. The method according to claim 1, wherein a carbon dioxide concentration inside the cover is substantially the same as a carbon dioxide concentration outside of the cover.

26. The method according to claim 1, wherein covering the entire load on a unit load device or on a skid transported by air via a cover, such that the cover separates the entire load on the unit load device or on the skid from the surrounding environment, and securing the cover in a covered position around the entire load on the unit load device or on the skid such that the cover separates the entire load on the unit load device or on the skid from the surrounding environment, comprises:

positioning at least a portion of the cover on the unit load device or skid and positioning the entire load on the cover such that the at least the portion of the cover is between the unit load device or skid and the entire load; and positioning a remaining portion of the cover and securing the cover, such that the cover is in a covered position around the entire load on the unit load device or on the skid such that the cover separates the entire load on the unit load device or on the skid from the surrounding environment.

* * * * *

UNITED STATES PATENT AND TRADEMARK OFFICE

CERTIFICATE OF CORRECTION

PATENT NO. : 8,499,533 B2
APPLICATION NO. : 13/174143
DATED : August 6, 2013
INVENTOR(S) : Jean-Pierre Emond and William Pelletier It is certified that error appears in the above-identified patent and that said Letters Patent is hereby corrected as shown below:

In the Specification

Column 1,
Lines 52-53, "may results in" should read --may result in--.
Line 67, "to number of" should read --to a number of--.

Column 6,
Lines 10-11, "can calculated" should read --can be calculated--.

In the Claims

Column 6, Claim 1,
Line 51, "a load" should read --an entire load--.
Line 52, "by air," should read --by air via a cover, such that the cover separates the entire load on the unit load device or on the skid from the surrounding environment,--.
Lines 53-54, "the load on or in the unit load device or on the skid, wherein" should read --the entire load on the unit load device or on the skid such that the cover separates the entire load on the unit load device or on the skid from the surrounding environment, wherein--.
Lines 55-56, "the load on or in the unit load device" should read --the entire load on the unit load device--.
Line 59, "$Lo_2/(m^2$ atm d)" should read --$L_{O2}/(m^2$ atm d)--.
Line 61, "$Lco_2/(m^2$ atm d)" should read --$L_{CO2}/(m^2$ atm d)--.
Line 63, "$g_{water}$/(m2 atm d)" should read --$g_{water}/(m^2$ atm d)--.

Signed and Sealed this
Twenty-ninth Day of July, 2014

Michelle K. Lee

Michelle K. Lee
*Deputy Director of the United States Patent and Trademark Office*